US008944790B2

(12) United States Patent
Ma

(10) Patent No.: US 8,944,790 B2
(45) Date of Patent: Feb. 3, 2015

(54) COMPRESSOR WITH CYCLONE AND INTERNAL OIL RESERVOIR

(75) Inventor: YoungChan Ma, Bloomington, MN (US)

(73) Assignee: Thermo King Corporation, Minneapolis, MN (US)

( * ) Notice: Subject to any disclaimer, the term of this patent is extended or adjusted under 35 U.S.C. 154(b) by 1075 days.

(21) Appl. No.: 12/908,494

(22) Filed: Oct. 20, 2010

(65) Prior Publication Data

US 2012/0099966 A1 Apr. 26, 2012

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/04*** | (2006.01) |
| ***F01C 21/06*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |
| *F04C 18/02* | (2006.01) |

(52) U.S. Cl.

CPC ..... *F04C 29/026* (2013.01); *F04C 18/0215* (2013.01); *F04C 2240/809* (2013.01)

USPC ..... 418/55.2; 418/55.1; 418/55.6; 418/89; 418/99; 418/94

(58) Field of Classification Search

USPC ..... 418/55.1, 55.2, 55.6, 89, 99, 94, 859, 418/85

See application file for complete search history.

(56) References Cited

U.S. PATENT DOCUMENTS

| | | | | |
|---|---|---|---|---|
| 3,776,668 | A | 12/1973 | Abendschein | |
| 5,088,905 | A * | 2/1992 | Beagle | 418/55.1 |
| 5,211,031 | A | 5/1993 | Murayama et al. | |
| 5,213,490 | A | 5/1993 | Yamamoto et al. | |
| 5,263,822 | A | 11/1993 | Fujio | |
| 5,345,785 | A | 9/1994 | Sekigami et al. | |
| 5,358,392 | A | 10/1994 | Ukai | |
| 5,593,297 | A | 1/1997 | Nakajima et al. | |
| 5,795,139 | A | 8/1998 | Ikeda et al. | |
| 6,017,205 | A * | 1/2000 | Weatherston et al. | 418/55.6 |
| 6,086,343 | A | 7/2000 | Sun et al. | |
| 6,139,295 | A | 10/2000 | Utter et al. | |
| 6,257,840 | B1 * | 7/2001 | Ignatiev et al. | 417/310 |
| 6,471,499 | B1 | 10/2002 | Sun | |

(Continued)

*Primary Examiner* — Thai Ba Trieu
*Assistant Examiner* — Dapinder Singh
(74) *Attorney, Agent, or Firm* — Hamre, Schumann, Mueller & Larson, P.C.

(57) ABSTRACT

A rotary compressor including a housing that defines an inlet, a low pressure chamber, an outlet, and a high pressure chamber defining a high pressure lubricant sump. A drive shaft passes through the housing and a compression element is coupled to the drive shaft between the low pressure chamber and the high pressure chamber. A first path connects the high pressure lubricant sump to the low pressure chamber such that lubricant flows through the first path from the high pressure lubricant sump to the low pressure chamber. A low pressure lubricant sump is positioned within the low pressure chamber and includes a movable gate movable from a closed position to an open position in response to a hydrostatic pressure of the lubricant within the low pressure lubricant sump. A second path connects a lubricant separator and the low pressure lubricant sump.

8 Claims, 3 Drawing Sheets

(56) References Cited

U.S. PATENT DOCUMENTS

| | | | | |
|---|---|---|---|---|
| 6,506,039 | B1 | 1/2003 | Osumimoto et al. | |
| 6,585,496 | B1 | 7/2003 | Sun | |
| 6,648,607 | B2 | 11/2003 | Milliff et al. | |
| 6,881,046 | B2 * | 4/2005 | Shibamoto et al. | 418/55.2 |
| 7,118,358 | B2 | 10/2006 | Tsubono et al. | |
| 7,140,852 | B2 | 11/2006 | Koide et al. | |
| 7,195,470 | B2 | 3/2007 | Kimura et al. | |
| 7,556,483 | B2 | 7/2009 | Gennami et al. | |
| 7,585,164 | B2 * | 9/2009 | Joo et al. | 418/55.1 |
| 8,043,079 | B2 * | 10/2011 | Yoo et al. | 418/88 |
| 8,512,017 | B2 * | 8/2013 | Yamamoto et al. | 418/55.2 |
| 2009/0173095 | A1 * | 7/2009 | Bhatia et al. | 62/236 |
| 2009/0285708 | A1 | 11/2009 | Yokoi et al. | |
| 2010/0307173 | A1 * | 12/2010 | Guo et al. | 62/84 |
| 2011/0085925 | A1 * | 4/2011 | Fan et al. | 417/321 |

* cited by examiner

COMPRESSOR WITH CYCLONE AND INTERNAL OIL RESERVOIR

BACKGROUND

The present invention relates to rotary compressors. More specifically, the invention relates to external drive rotary compressors and lubrication systems therefore. Typically, external drive compressors include components that require lubrication. Various arrangements have been used in the past to provide lubrication to components within the compressor. For example, a low pressure lubricant sump is a common way to provide lubrication to the compressor components.

SUMMARY

In one embodiment, the invention provides a rotary compressor that includes a housing that defines an inlet in communication with a low pressure chamber and an outlet in communication with a high pressure chamber. The high pressure chamber defines a high pressure lubricant sump. A drive shaft at least partially passes through the housing and a compression element is coupled to the drive shaft such that it is in fluid communication between the low pressure chamber and the high pressure chamber. The compression element compresses a working fluid. A lubricant separator is in fluid communication between the high pressure chamber and the outlet to separate lubricant from the working fluid and a first path connects the high pressure lubricant sump to the low pressure chamber such that lubricant flows through the first path from the high pressure lubricant sump to the low pressure chamber. A low pressure lubricant sump is positioned within the low pressure chamber and includes a movable gate. The movable gate is movable from a closed position to an open position in response to a hydrostatic pressure of the lubricant within the low pressure lubricant sump reaching a threshold hydrostatic pressure. A second path connects the lubricant separator and the low pressure lubricant sump.

In another embodiment the invention provides a rotary compressor that includes a housing that defines a high pressure portion and a low pressure portion. A drive shaft passes at least partially through the housing and is coupled to a compression element positioned between the high pressure portion and the low pressure portion. A high pressure sump is positioned in the high pressure portion, a low pressure sump is positioned in the low pressure portion, a first lubricant separator is in communication with the high pressure sump, and a second lubricant separator is in communication with the low pressure sump.

In another embodiment the invention provides a rotary compressor that includes a housing that defines a high pressure portion and a low pressure portion. A drive shaft passes at least partially through the housing and is coupled to a compression element positioned between the high pressure portion and the low pressure portion. A low pressure sump is positioned in the low pressure portion and a cyclonic lubricant separator is positioned in the high pressure portion and is in communication with the low pressure sump.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
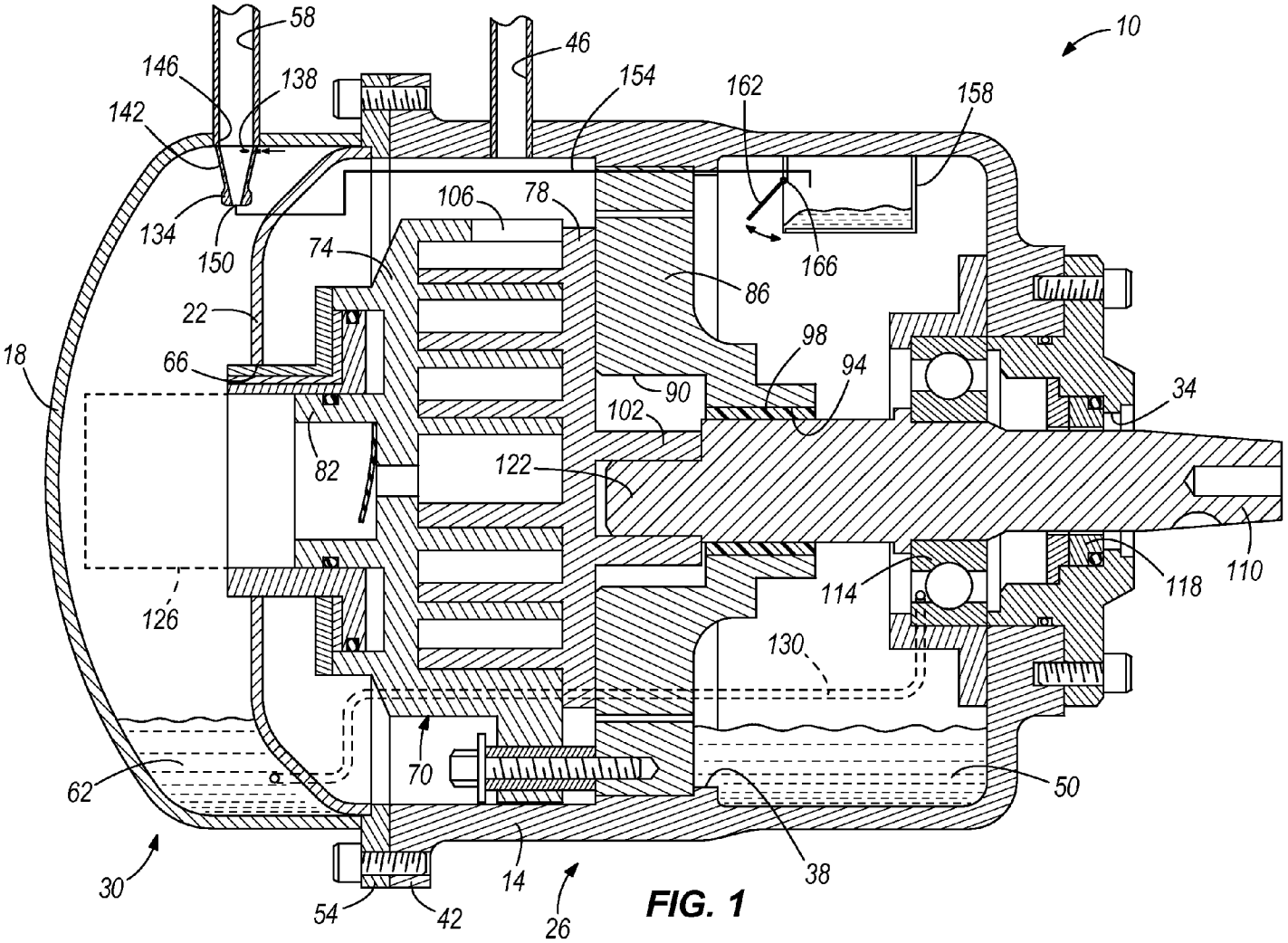
FIG. 1 is a sectional view of a compressor according to one construction of the invention.

FIG. 1 shows a compressor in the form of a scroll compressor 10 that compresses a working fluid. A lubrication system provides lubricant to various components within the scroll compressor 10. The scroll compressor 10 is an external drive type compressor driven by a prime mover (not shown). In other constructions, the compressor may be a screw-type compressor, or another type of compressor, as desired. Additionally, the layout of the illustrated scroll compressor 10 is for illustrative purposes only; the arrangement of components may be altered.

The scroll compressor 10 includes a housing 14 and a cap 18 that includes a divider wall 22. A low pressure side 26 is confined by the divider wall 22 and the housing 14 and a high pressure side 30 is confined by the divider wall 22 and the cap 18. The housing 14 defines a drive aperture 34, a scroll flange 38, a housing flange 42, and an inlet 46. A low pressure sump 50 is defined in a lower portion of the housing 14. The illustrated low pressure sump 50 does not always include standing lubricant as illustrated. At times, the low pressure sump 50 may have more or less lubricant held therein. In other constructions, the housing 14 may be arranged differently (e.g., different component locating features, different sump arrangement, etc.), as desired.

The cap 18 includes a cap flange 54 that couples to the housing flange 42 to substantially seal the scroll compressor 10, and an outlet 58. A high pressure sump 62 is defined in a lower portion of the cap 18. The illustrated divider wall 22 includes a high pressure aperture 66 that fluidly connects the high pressure side 30 to the low pressure side 26. In other constructions, the cap 18 may have a different shape, be formed as separate pieces, or mate to the housing differently, as desired.

A compression element in the form of a scroll set 70 is positioned within the housing 14 to compress a mixture of working fluid and lubricant. The scroll set 70 includes a fixed scroll member 74 and a orbiting scroll member 78. Each scroll member 74, 78 includes a wrap that intermeshes with the other scroll member 78, 74 to form compression chambers. The fixed scroll member 74 includes a scroll outlet 82 that sealing engages the high pressure aperture 66 of the divider wall 22. Further, the fixed scroll member 74 is mounted to a plate 86 that is fixedly attached to the scroll flange 38 of the housing 14. The plate 86 defines a cavity 90 and a bearing seat 94 and a bearing in the form of a bushing 98 is disposed therein. The orbiting scroll member 78 includes a socket 102 that extends into the cavity 90 of the plate 86. The fixed scroll member 74 and the orbiting scroll member 78 cooperate to define a scroll inlet 106. In other constructions, the compression element may include the components of a screw compressor, a piston compressor, or another desirable compressor type.

A drive shaft 110 passes through the drive aperture 34 and is rotatably mounted to the housing 14 with a main drive bearing 114. A shaft seal 118 inhibits lubricant leakage adjacent the drive shaft 110. The illustrated drive shaft 110 is also supported for rotation by the bushing 98 and includes an off center projection 122 that engages the socket 102 of the orbiting scroll member 78 to drive the orbiting scroll member 78. The illustrated drive shaft 110 passes fully through the wall of the housing 14. However, in alternate constructions, the drive shaft 110 may pass only partially through the housing 14 or be surrounded by the housing 14, as desired. Other arrangements exist to provide a drive shaft 110 to power the compressor 10 and have been considered. Further, the arrangement of the drive shaft 110 will be different if a different type of compressor is utilized, as will be understood by one skilled in the art. The illustrated main drive bearing 114 includes races and ball bearings. Other types of bearings may be utilized as desired.

A first lubricant separator in the form of a separator screen 126 is positioned to cover the high pressure aperture 66 of the divider wall 22. The illustrated separator screen 126 includes perforations that allow the mixture of working fluid and lubricant to flow therethrough. As the mixture flows through the separator screen 126, a majority of lubricant is separated from the working fluid and drains to the high pressure sump 62. In other embodiments, the first lubricant separator may be an impinging separator, or another type of separator, as desired.

A first path in the form of a tube 130 connects the lubricant in the high pressure sump 62 with the main drive bearing 114 to provide lubricant to the main drive bearing 114. The high pressure within the high pressure side 30 pushes the lubricant through the tube 130 and into the main drive bearing 114. Other paths or tubes may be provided to directly lubricate other components, as desired. For example, a tube may be provided to lubricate the bushing.

Figure 2:
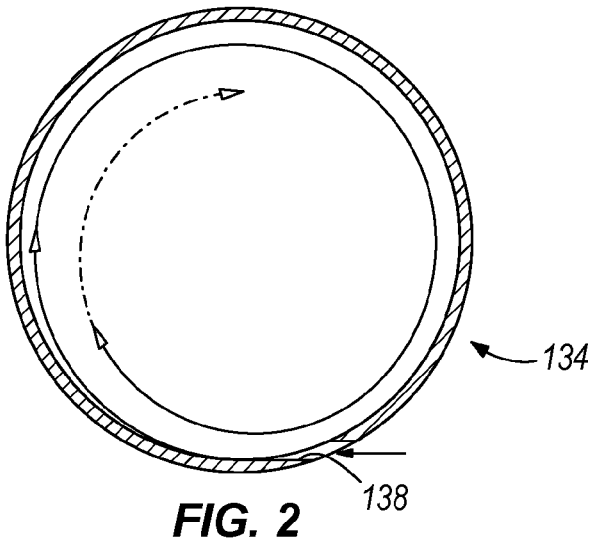
FIG. 2 is a top view of a cyclonic separator of the compressor of FIG. 1.
Figure 3:
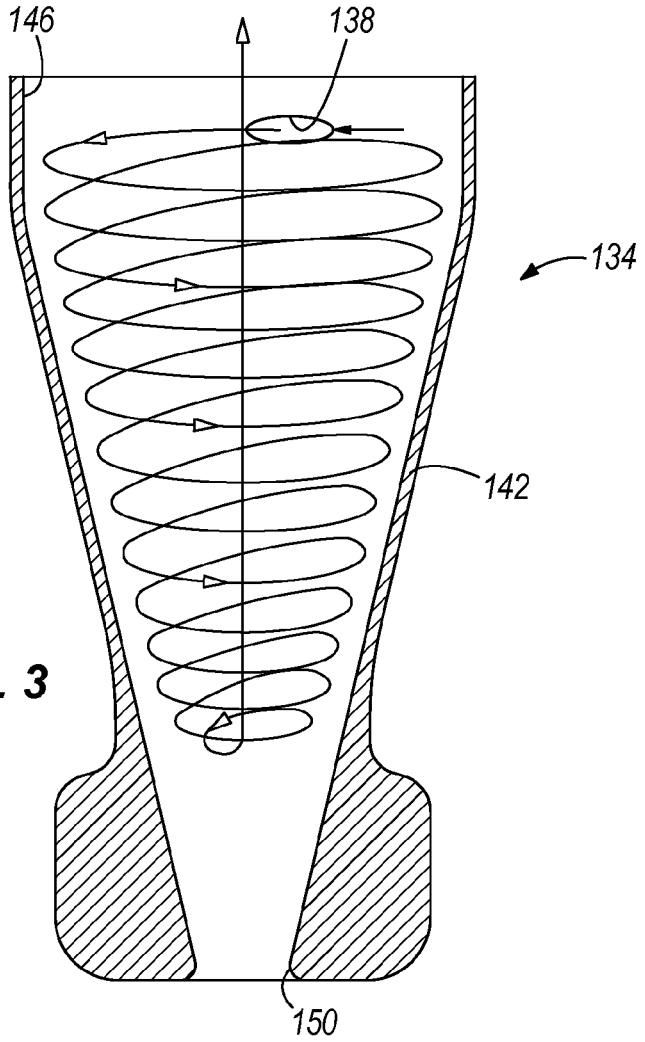
FIG. 3 is a cross sectional view of the cyclonic separator of FIG. 2.
Figure 4:
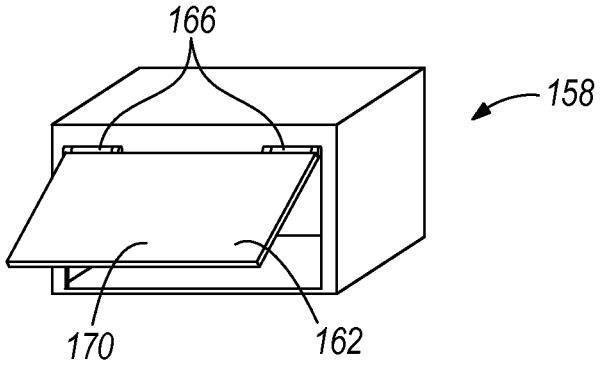
FIG. 4 is a low pressure sump of the compressor of FIG. 1.
Figure 5:
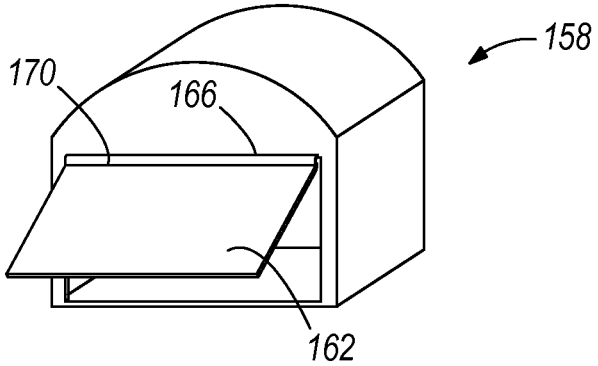
FIG. 5 is another construction of the low pressure sump.
Figure 6:
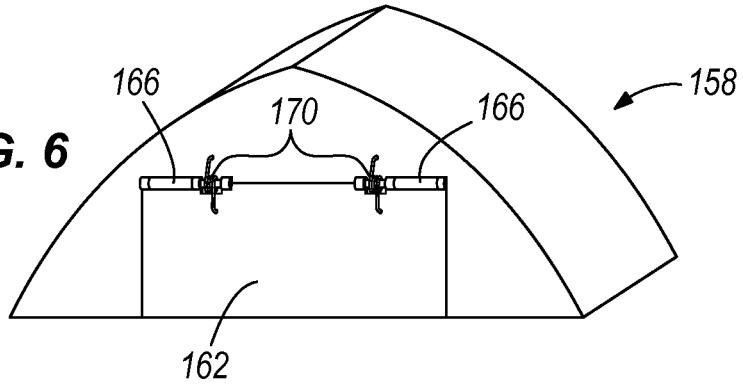
FIG. 6 is another construction of the low pressure sump.
Figure 7:
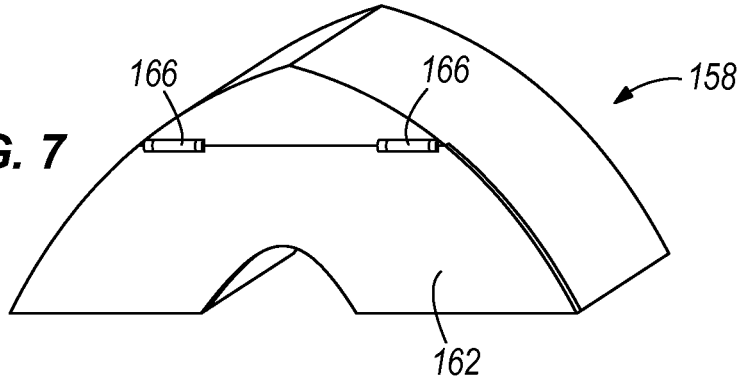
FIG. 7 is another construction of the low pressure sump.

A second lubricant separator in the form of a cyclonic separator 134 is positioned adjacent the outlet 58. With reference to FIGS. 2 and 3, the cyclonic separator 134 includes an inlet 138 that receives a flow of high pressure working fluid and lubricant from the high pressure side 30, a conical portion 142, an outlet 146 that expels working fluid substantially free of lubricant, and a drain 150 that expels separated lubricant. The illustrated inlet 138 is a tangential inlet. The illustrated outlet 146 is positioned at the top center of the cyclonic separator 134. The drain 150 is positions at the bottom of the conical portion 142 such that lubricant collects into the drain 150. In other constructions, the cyclonic separator 134 may be shaped differently to produce a cyclonic flow therein. For example, the conical portion 142 may have parabolic shaped sides, or another profile, as desired. Further, the shapes of the inlet 138, outlet 146, or drain 150 may be different.

Turning back to FIG. 1, a second path in the form of a tube 154 connects the drain of the cyclonic separator 134 to an internal reservoir 158 positioned in the low pressure side 26 within the housing 14. The internal reservoir 158 includes walls that define a volume and a movable gate 162. The illustrated movable gate 162 includes a hinge 166 adjacent a top portion, and a sealing surface. The movable gate 162 is movable between an open position where lubricant held within the internal reservoir 158 may flow out of the internal reservoir 158, and a closed position where lubricant is substantially maintained within the internal reservoir 158.

The illustrated movable gate 162 is biased toward the closed position by a biasing element 170 (e.g., a spring, living spring, weight, etc.) (see FIGS. 4-7) such that it moves from the closed position to the open position in response to a hydrostatic pressure above a threshold value. That is to say, as lubricant collects in the internal reservoir 158, a hydrostatic pressure of the lubricant will rise. Once the hydrostatic pressure reaches the threshold value, the gate 162 moves from the closed position to the open position and allows lubricant to spill from the internal reservoir 158.

The illustrated internal reservoir 158 is positioned vertically above the drive shaft 110 and above the low pressure sump 50. When the lubricant is spilled into the housing 14, the components of the compressor 10 receive extra lubrication, and the lubricant collects within the low pressure sump 50. The biasing element 170 is configured such that fluid flow is balanced between the high pressure sump 62, the low pressure sump 50, and the internal reservoir 158 to provide lubricant to the components of the compressor 10.

FIGS. 4-7 show alternative internal reservoirs 158. The internal reservoir 158 can be shaped to fit within a particular portion of the housing 14, as desired. The different internal reservoirs 158 function the same, but allow the invention to be practiced in a wide variety of compressors.

The internal reservoir 158 increases the lubricant capacity of the compressor 10 without increasing the package size, including an external lubricant reservoir, or overloading the low pressure sump. As such, the compressor 10 has a larger volume of lubricant and therefore improve the lubrication of the components. The cyclonic separator 134 cooperates with the separator screen 126 to remove the lubricant from the working fluid before the high pressure working fluid exits the outlet 58.

Various features and advantages of the invention are set forth in the following claims.

What is claimed is:

1. A rotary compressor comprising:

a housing defining an inlet in communication with a low pressure chamber and an outlet in communication with a high pressure chamber defining a high pressure lubricant sump;

a drive shaft at least partially passing through the housing;

a compression element coupled to the drive shaft and in fluid communication between the low pressure chamber and the high pressure chamber, the compression element compressing a working fluid;

a lubricant separator in fluid communication between the high pressure chamber and the outlet to separate lubricant from the working fluid;

a first path connecting the high pressure lubricant sump to the low pressure chamber such that lubricant flows through the first path from the high pressure lubricant sump to the low pressure chamber;

an internal reservoir positioned within the low pressure chamber and including a movable gate, the movable gate being configured to open from a closed position to an open position in response to a hydrostatic pressure of the lubricant within the internal reservoir reaching a threshold hydrostatic pressure thereby allowing lubricant to exit the internal reservoir; and a second path connecting the lubricant separator and the internal reservoir.

2. The rotary compressor of claim 1, wherein the lubricant separator includes a separator inlet for receiving working fluid and lubricant, a conical portion for separating the lubricant from the working fluid, a separator outlet for expelling working fluid, and a separator drain for expelling lubricant.

3. The rotary compressor of claim 1, wherein the lubricant separator is a cyclonic separator.

4. The rotary compressor of claim 1, further comprising a second lubricant separator positioned in the high pressure chamber to separate lubricant from working fluid such that lubricant collects in the high pressure sump.

5. The rotary compressor of claim 1, wherein the internal reservoir collects lubricant separated by the lubricant separator and a hydrostatic pressure increases as lubricant collects, the movable gate opens at a predetermined hydrostatic pressure.

6. The rotary compressor of claim 1, wherein the housing defines a collecting portion for collecting lubricant in the low pressure chamber and the internal reservoir is positioned above the collecting portion.

7. The rotary compressor of claim 1, wherein the compression element includes a first scroll driven by the drive shaft and a stationary second scroll coupled to the housing.

8. The rotary compressor of claim 1, wherein the lubricant separator is positioned adjacent to the outlet within the high pressure chamber.

* * * * *